United States Patent [19]

Wright

[11] Patent Number: 4,615,742

[45] Date of Patent: Oct. 7, 1986

[54] PROGRESSING BATCH HYDROLYSIS PROCESS

[75] Inventor: John D. Wright, Denver, Colo.

[73] Assignee: The United States of America as represented by the Department of Energy, Washington, D.C.

[21] Appl. No.: 690,544

[22] Filed: Jan. 10, 1985

[51] Int. Cl.[4] ..... C13K 1/02

[52] U.S. Cl. ..... 127/37

[58] Field of Search ..... 127/1, 36, 37, 42; 162/14, 16

[56] References Cited

U.S. PATENT DOCUMENTS 2,778,751 1/1957 Riehm ..... 127/1 X 4,427,453 1/1984 Reitter ..... 127/37 X

OTHER PUBLICATIONS

Riegel's Handbook of Industrial Chemistry, Seventh Edition edited by Kent, James A., pp. 436–475, (1974).

*Primary Examiner*—Richard V. Fisher

*Assistant Examiner*—W. Gary Jones

*Attorney, Agent, or Firm*—Kenneth L. Richardson; James W. Weinberger; Judson R. Hightower

[57] ABSTRACT

A progressive batch hydrolysis process for producing sugar from a lignocellulosic feedstock, comprising passing a stream of dilute acid serially through a plurality of percolation hydrolysis reactors charged with said feedstock, at a flow rate, temperature and pressure sufficient to substantially convert all the cellulose component of the feedstock to glucose; cooling said dilute acid stream containing glucose, after exiting the last percolation hydrolysis reactor, then feeding said dilute acid stream serially through a plurality of prehydrolysis percolation reactors, charged with said feedstock, at a flow rate, temperature and pressure sufficient to substantially convert all the hemicellulose component of said feedstock to glucose; and cooling the dilute acid stream containing glucose after it exits the last prehydrolysis reactor.

18 Claims, 1 Drawing Figure

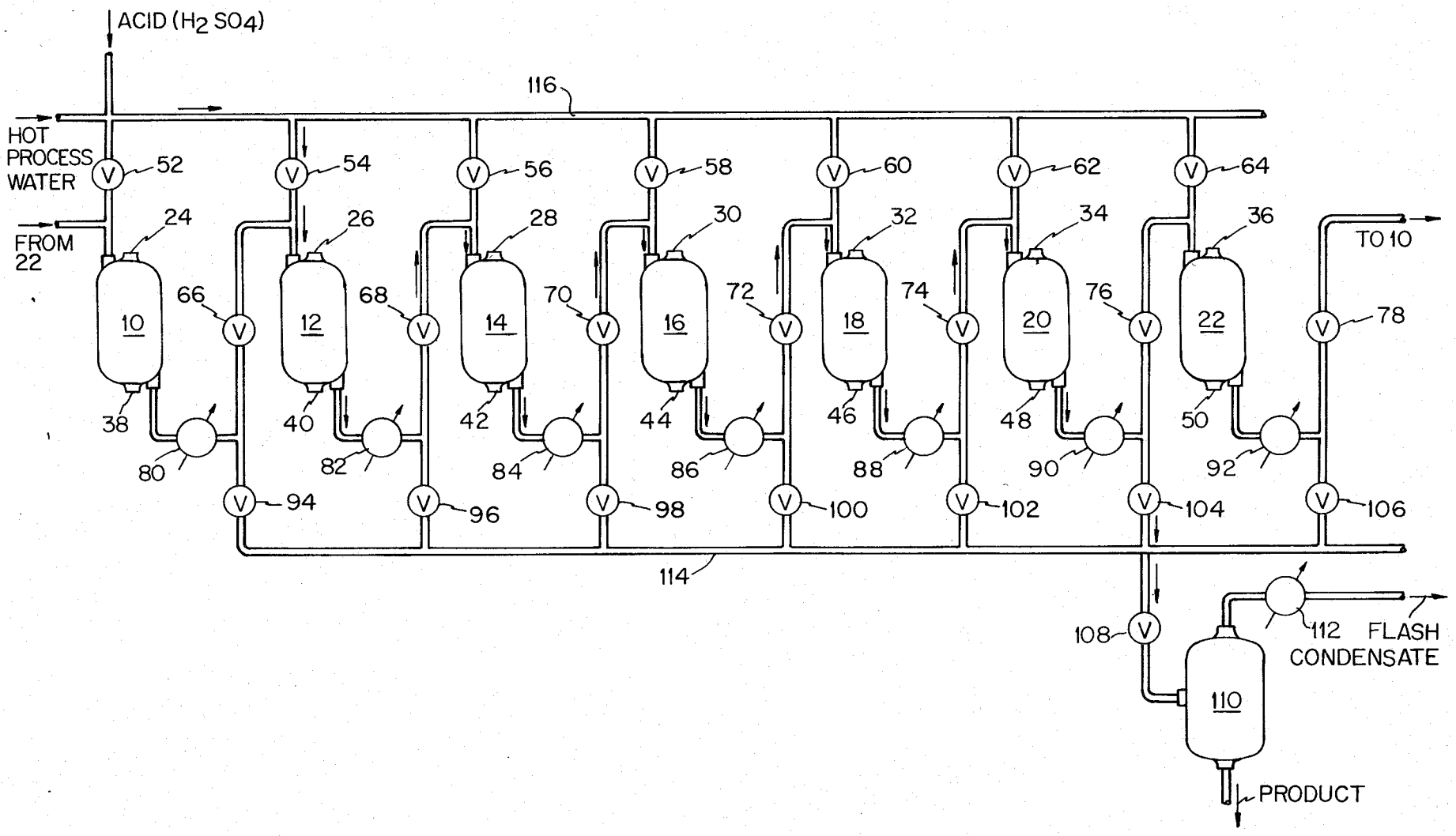
TO 10
FLASH CONDENSATE
PRODUCT
ACID ($H_2SO_4$)
HOT PROCESS WATER
FROM 22
10
12
14
16
18
20
22
110
112
114
116

PROGRESSING BATCH HYDROLYSIS PROCESS

CONTRACTUAL ORIGIN OF THE INVENTION

The U.S. Government has rights in this invention pursuant to Contract No. DE-AC02-83CH10093 between the U.S. Department of Energy and the Solar Energy Research Institute, a Division of Midwest Research Institute.

BACKGROUND OF THE INVENTION

1. Field of the Invention

The present invention relates to the conversion of lignocellulosic feedstock by hydrolysis to obtain simple sugars, such as glucose and xylose.

2. Description of the Prior Art

It is known that lignocellulosic feedstock, such as particulate wood in the form of chips, sawdust and shavings, can be converted by acid hydrolysis to produce simple sugars, such as glucose and xylose, which can then be fermented to produce ethanol and many other fuels or chemicals. In developing commercial acid hydrolysis processes, problems have been encountered due to the low sugar yields caused by the degradation of the sugar and low sugar concentration in the product stream, the corrosive nature of the acid, and the difficulties of conveying solids into and out of a pressurized hydrolysis reactor.

Chemically, the cell wall tissue of wood is a complex mixture of polymers. These polymers are classified into two groups, the polysaccharides and lignin. The polysaccharides of wood are collectively known as holocellulose, which means total cellulosic carbohydrates. The holocellulose accounts for about 70 to 80 percent of the extractive-free woody tissue, with lignin comprising the remainder.

The holocellulose is composed of cellulose and a mixture of other polysaccharides, collectively known as hemicelluloses.

Cellulose is a high molecular weight linear polymer composed of glucose anhydride units. Hemicellulose is a mixture of shorter chain polymers of the anhydrides of xylose, arabinose, glucose, mannose, and galactose, with xylan and galactoglucomannan as the most prevalent species.

Lignin is a complex polymer of condensed phenylpropane units, and functions as the adhesive material of wood, joining together the fibers and other cells to form the firm anatomical structure of wood.

The major chemical reactions in the acid hydrolysis of lignocellulose can be represented by the following reactions of cellulose and xylan:

$$\text{Cellulose} + \text{water} \xrightarrow{\text{acid}} \text{glucose} \xrightarrow{\text{acid}}$$

$$(C_6H_{10}O_5)_n \quad nH_2O \quad nC_6H_{12}O_6$$

$$\text{hydroxymethylfurfural} + \text{water} \xrightarrow{\text{acid}} \text{levulinic acid} + \text{formic acid}$$

$$\text{Xylan} + \text{water} \xrightarrow{\text{acid}} \text{xylose} \longrightarrow$$

$$C_5H_8O_4 \quad H_2O \quad C_5H_{10}O_5$$

-continued $$\text{furfural} + \text{water} \longrightarrow \text{tars}$$

$$C_4H_3OCHO \quad 3H_2O$$

The cellulose reaction is characteristic of the reactions of the six carbon sugar components (cellulose, and the glucose, galactose, and mannose fractions of hemicellulose) while the xylan reaction is characteristic of the reactions of the five carbon fraction of the hemicellulose (xylose and arabinose).

Glucose, galactose and mannose are yeast fermentable sugars, whereas the pentoses, such as xylose and arabinose are nonfermentable.

Hemicelluloses hydrolyze substantially more easily and rapidly than cellulose. For example, temperatures and acid concentrations that require a few hours to hydrolyze cellulose to glucose, can readily convert much of the hemicellulose into simple sugars in a matter of minutes.

Under conditions where hydrolysis occurs, the sugars that form will undergo decomposition in the presence of the acid, with the pentoses decomposing more rapidly than the hexoses. Varying the conditions of acid hydrolysis changes the rate of the hydrolysis and degradation reactions, and causes variations in the yields of the various sugar products.

The typical mechanism of a dilute acid hydrolysis process involves contacting wood particles, which can be in the form of chips, shavings or sawdust, with a heated dilute acid solution in a pressurized reaction chamber. The dilute acid is generally an inorganic acid, such as sulfuric, hydrochloric, phosphoric, nitric, or hydrofluoric, with sulfuric being preferred. This results in a solid phase reaction between the acid and the particulate wood, which yields the desired glucose product suspended in the dilute acid solution. As the desired products are the sugars, it is important to stop the reactions before the sugars can decompose to hydroxymethylfurfural (HMF), furfural, and other degradation products.

One known method for converting particulate wood to glucose is by means of plug-flow hydrolysis, which comprises premixing particulate wood with a dilute acid solution, followed by passing the mixture through a reactor at elevated temperature and pressure. In plug-flow hydrolysis, the particulate wood chips and dilute acid solution remain in the reactor for the same amount of time. In order to minimize degradation, the reaction is conducted at very high temperatures, on the order of about 200°-260° C., wherein the sugar formation reaction proceeds at a faster rate than the degradation reaction. However, practical drawbacks limit the yield of this process to about 50-60%. Also, the sugars produced are quite dilute due to the low yields and to the difficulty of pumping concentrated slurries. In general, the movement of particulate wood, especially under pressure, is a mechanically complex process, and is often the most difficult and expensive step involved.

In another method, called "percolation hydrolysis," a dilute acid solution is passed through a reactor chamber packed with particulate wood. The wood remains in the reactor long enough for complete hydrolysis to occur, but the water and acid flows through the reactor with a much shorter residence time. Thus, the sugars diffuse from the wood into the liquid phase and are washed out of the reactor and cooled, before substantial degradation can occur.

The cooling of the hydrolyzate and the quenching of the reactions can best be accomplished by passing the acid stream through a flash valve and into a flash tank, which brings about rapid cooling. At temperatures at or below about 120°–140° C., the sugar degradation reactions do not occur at an appreciable rate. The sugar-water-acid stream is then neutralized, and the sugar undergoes fermentation to the final product by conventional means known in the art.

A disadvantage of percolation hydrolysis is that very large amounts of dilute acid solution are necessary to wash the sugars quickly from the reactor and thus, the concentration of sugar product in the dilute acid solution can be quite low. The advantage of the process is that it is relatively simple proven technology. All solids handling is carried out at ambient temperature and atmospheric pressure. Percolation reactors were developed in Germany in the 1920's and 1940's, and are used extensively in the U.S.S.R.

Another method proposed for producing sugars from particulate wood is by means of counter-current hydrolysis. In counter-current hydrolysis, a flow of dilute acid solution contacts a body of particulate wood which is moving in a direction opposite to the flow of the dilute acid solution. The counter-current flow of the dilute acid solution and the particulate wood results in a much higher yield of sugars from the wood, minimal degradation, and a relatively high concentration of glucose in the dilute acid solution.

The primary disadvantage of counter-current hydrolysis is the extreme mechanical complexity and expense of moving the solids and liquids in opposite directions, the difficulty of achieving good liquid-solid contact, and the inability to impose a temperature profile in a single vessel. In theory, the counter-current reactor is the most efficient type of hydrolysis reactor, but no practical counter-current reactor designs have yet been demonstrated.

SUMMARY OF THE INVENTION

Against this background, it is therefore a general object of the present invention to more efficiently extract significantly higher amounts of sugars (glucose, xylose, and the like) from particulate wood.

Another general object is to minimize the degradation of the desired sugar products by separating them from the reactor as soon as possible.

Another general object is to maximize the concentration of sugar product in the liquid acid solution removed from the reactor chamber in order to minimize the amount of energy input and capital cost required in subsequent distillation and/or fermentation processes.

Still another general object is to minimize the energy consumption associated with the hydrolysis procedure in order to further improve its efficacy.

It is a more specific object to provide a particular operating system and scheme in which to accomplish the improved hydrolysis process for converting lignocellulosic feedstock, such as particulate wood, to simple sugars suspended in a liquid end product.

Additional objects, advantages and novel features of the invention shall be set forth in the description that follows, and in part will become apparent to those skilled in the art upon examination following disclosure, or may be learned by the practice of the invention. The objects and the advantages of the invention may be realized and attained by means of the instrumentalities and in combinations particularly pointed out in the appended claims.

The present invention relates to a progressing batch hydrolysis process, which achieves the increased sugar yields and concentrations promised by counter-current operation without the necessity for moving a stream of particulate wood. Progressing batch hydrolysis uses a plurality of percolation reactors in series to approximate counter current flow of liquids and solids. The system combines the mechanical simplicity of the percolation reactor with the yield and concentration advantages of a counter current reactor. This is accomplished by:

(a) passing a stream of dilute acid serially through a plurality of hydrolysis percolation reactors charged with said feedstock, at a flow rate, temperature and pressure sufficient to convert the cellulose component of the feedstock to glucose;

(b) cooling said dilute acid stream containing glucose, after exiting the hydrolysis percolation reactors, then feeding said dilute acid stream serially through a plurality of prehydrolysis percolation reactors, charged with said feedstock, at a flow rate, temperature and pressure sufficient to convert the hemicellulose component of said feedstock to xylose, glucose and other sugars;

(c) achieving the apparent motion of the solids through the reactor by moving the inlet and outlet of the liquid stream;

(d) cooling and recovering the dilute acid stream containing the sugars after it exits the prehydrolysis reactors.

In this manner, the advantages of counter-current operation are achieved without the necessity of moving the solids.

BRIEF DESCRIPTION OF THE DRAWING

The accompanying drawing, FIG. 1, which is incorporated in and forms a part of the specification, is a schematic view of the operating system and illustrates preferred embodiments of the present invention, which together with the accompanying description, serve to explain the principles of the invention.

DESCRIPTION OF THE PREFERRED EMBODIMENTS

In accordance with the present invention, a progressing batch hydrolysis process is provided which approximates a counter-current flow hydrolysis process without the necessity for actual movement of the wood particles. In general, a plurality of percolation hydrolysis reactors are piped together in series. The series of reactors which operate at high temperatures, on the order of about 180° C., are designated as "hydrolysis reactors," and the series of reactors which operate at temperatures of about 150° C., are designated as "prehydrolysis reactors."

It has been found that yield and operability are improved by conducting a prehydrolysis and then a hydrolysis. By prehydrolyzing fresh feedstock at about 150° C., the sugars from the hemicellulose and amorphous cellulose can be hydrolyzed at temperatures where sugar degradation is insignificant.

This allows high yields on hemicellulose, opens up the structure of the wood chip so that diffusion of acid and sugars is enhanced, and minimizes fouling in the pipes by tars and other degradation products.

The hydrolysis of cellulose to form sugars is a solid phase reaction, catalyzed by acid which has absorbed onto the cellulose. Therefore, even though acid hydrolysis kinetics are normally correlated with acid concentration in the liquid phase, the variable of importance is actually the acid absorbed by the wood. Further, the acid in the liquid phase is the acid which catalyzes the sugar degradation reactions. Therefore, it can be possible to achieve improved performance by soaking the wood chips in acid to contact the cellulose inside the chips, and then using acid free or less concentrated acid/water solutions to wash the sugar out of the chips.

Each of the reactors are prefilled with wood particles. The last hydrolysis reactor in the series, that is, the reactor which has contained solids for the longest time, is then supplied with a dilute acid solution which then passes sequentially through each of the hydrolysis reactors at a designated flow rate, is cooled and passes through the series of prehydrolysis reactors, and is cooled once again by exiting through a flash tank, and contains the containing sugar liquid product.

The final hydrolysis reactor is then disconnected from the acid supply and operating sequence, is cleaned and replenished with a fresh charge of wood particles. As this is being accomplished the adjacent hydrolysis reactor becomes the last reactor in the series and is directly connected to the dilute acid supply.

At the same time, the first reactor in the series, which is a "prehydrolysis reactor", becomes the second reactor by being connected to the reactor freshly charged with wood particles. This freshly charged reactor thereby becomes the first prehydrolysis reactor in the next sequence of operation.

After each new sequence of operation, a similar change in the configuration of reactors is made.

By piping all reactors with suitable valve connections, the task of disconnecting and bypassing spent reactors while they are being recharged, and connecting freshly charged reactors to the operating system, is simplified. A typical example of such a configuration is shown in the schematic view of FIG. 1 which shows the progressing batch system in mid cycle.

The drawing comprises a series of hydrolysis reactors 10, 12, 14, 16, 18, 20 and 22. Each reactor is equipped with inlet hatches 24, 26, 28, 30, 32, 34 and 36, respectively, as well as outlet hatches 38, 40, 42, 44, 46, 48 and 50, respectively. The inlet hatches allow for the supply of fresh particulate material, for example wood chips, whereas the outlet hatches enable the reactor to discard its spent material.

Each of the reactors is also equipped with supply valves 52, 54, 56, 58, 60, 62 and 64, respectively, to control the supply of hot process water and dilute acid, such as sulfuric acid, to each of the reactors.

The exit piping associated with each of the reactors is sequentially interconnected by means of associated piping and valves 66, 68, 70, 72, 74, 76 and 78, respectively.

The exit piping for each reactor also includes heat exchangers 80, 82, 84, 86, 88, 90 and 92, respectively.

At appropriate times during the operating sequence, the fluid flow will proceed through transfer valves 94, 96, 98, 100, 102, 104 and 106, flowing through pipe 114, flash valve 108, and flash tank 110, from which the product will be collected. Overhead flash vapors are condensed in heat exchanger 112.

The supply of hot process water and acid can enter any of the reactors through pipe 116, with its entry being controlled by any of the aforementioned associated supply valves.

In an exemplary operating cycle, the cellulose in reactor 10 is almost completely hydrolyzed, and the reactor is isolated from the operating system by closing valves 52, 66, 78 and 94, and opening outlet hatch 38, to empty the spent contents of the reactor.

Some time before reactor 10 is isolated and emptied, reactor 22 has also been isolated from the operating system by closing valves 64, 76, 78 and 106. Reactor 22 is already emptied, outlet hatch 50 has been closed, and the reactor 22 is charged with particulate wood feedstock through inlet hatch 36. The particulate feedstock, or wood chips, can be flushed with steam to remove air from the system. Reactor 22 is then sealed by closing hatch 36, and can then be pressurized with steam to the pressure which corresponds to the vapor pressure of water at the operating temperature of a prehydrolysis reactor. This prevents boiling in the prehydrolysis reactor when valve 76, which interconnects reactors 20 and 22 is opened.

For the time being, reactors 12, 14, 16, 18 and 20 are in the operating sequence. Reactor 10 has been isolated from the system and its spent contents are being discarded. Reactor 22 is being charged with particulate material and will be standing by to replace one of the operating reactors at the end of the operating cycle.

After reactor 10 has been emptied of its waste residue, it can then also be freshly charged with particulate wood.

In this particular operating cycle, reactors 12, 14 and 16 function as hydrolysis reactors, whereas reactors 18 and 20 function as prehydrolysis reactors.

Reactor 20 contains the freshest, least hydrolyzed particulate material, whereas reactor 12 is the 1ast active reactor. The general flow of liquids is from reactor 12 through to reactor 20.

The supply liquids comprising hot process water at a temperature of about 180° C., and dilute sulfuric acid enter reactor 12 by flowing through pipe 116, and supply valve 54. In order to accomplish sequential flow through reactors 12, 14, 16, 18 and 20, supply valves 52, 56, 58, 60, 62 and 64 are closed, as are transfer valves 94, 96, 98, 100, 102 and 106. Valves 68, 70, 72 and 74 are open, whereas valves 66, 76 and 78 are closed.

The hot process liquid will then flow sequentially through reactors 12, 14, 16, 18 and 20, passing through associated heat exchangers 82, 84, 86, 88 and 90, respectively. The liquid product exiting reactor 20 passes through heat exchanger 90, transfer valve 104, flash valve 108 and enters flash drum 110.

The flash vapors, containing steam, furfural, acetic acid, and other light organics are condensed in heat exchanger 112. The main liquid product, comprising a solution of sugars, such as glucose, xylose, arabinose, and the like, and degradation products such as hydroxymethylfurfural (HMF), furfural, levulinic acid, formic acid, tars, and the like, are removed from the bottom of the flash drum and recovered.

After a certain operating time, the cellulose feedstock in reactor 12 is almost completely hydrolyzed. Reactor 12 can then be isolated from the operating sequence and its spent contents discarded. Reactor 22 which has been freshly charged with lignocellulose in the form of particulate wood is standing by and ready to be introduced into the operating sequence.

Supply valve 54 and valve 68 and transfer valve 104 are closed, and supply valve 56, valve 78 and transfer valve **10*b* are opened. This diverts the initial flow of hot process water and liquid acid into hydrolysis reactor 14, where it flows in sequence through reactors 16, 18, 20 and 22, transfer valve 106, flash valve 108 and into flash tank 110**.

After another operating cycle ends, the sequence will progress to another reactor, such as reactor 10 which will be brought onstream, with reactor 14 being isolated from the system and its contents discarded.

In this manner, fresh feed is supplied at one end of the reactor train, and spent material is discarded at the other end. The stepwise introduction of the active reactor through the system, coupled with the flow of liquids in the opposite direction, whereby fresh feedstock is contacted with the liquid stream which has already traveled through the reactor train, approximates the action in a countercurrent reactor without the necessity for physically moving the solids into and out of a high pressure region.

As already noted, the hot process water and dilute acid enter the reactor train at conditions sufficient to hydrolyze crystalline cellulose. The hot process water temperature can vary from about 170°-195° C., and the concentration of sulfuric acid can vary from about 0.25 to 1.5% sulfuric acid. In the example described, the inlet condition for the operating cycle can be 180° C. hot water and 0.5 weight percent sulfuric acid. However, these conditions can vary for different lignocellulosic feedstocks.

Heat exchangers 80, 82, 84, 86, 88, 90 and 92 are used to adjust the temperature of the hydrolyzate stream between stages. Due to the fact that reactors and pipes will lose heat to the surroundings and because of the energy necessary to heat the reactor contents and walls of the reactor, the temperature will generally decrease from reactor to reactor. Therefore, the heat exchangers between the hydrolysis reactors are used to control the temperature of the hydrolyzate entering each reactor. As will be recognized by those skilled in the art, heating can also be accompanied by direct injection of steam into the hydrolyzate, or by using a heating jacket on the reactors.

Still another use of the heat exchangers located between the hydrolysis reactors can be to impose a temperature profile on the hydrolysis reactors. For example, it can be advantageous to operate reactors 14 and 16 at a higher temperature than reactor 12. If so, heat exchangers 82 and 84 would be used to further increase the temperature of the hydrolyzate.

The optimal number of hydrolysis reactors can vary. More numerous reactors can improve the yield and outlet sugar concentration by making the system approximate a countercurrent reactor. However, more numerous reactors can also increase the cost and complexity of the system.

In the operating system previously described, reactors 18 and 20 comprised prehydrolysis reactors, operating at conditions that are nominally 150° C. and 0.5% sulfuric acid. However, as with the hydrolysis reactors, the optimum reaction conditions will vary with feedstock composition. The important factor is to use relatively mild conditions where sugar degradation is negligible, and high yields and clean hydrolyzate can be obtained.

In the original operating cycle, the heat exchanger 86 is used to cool the hydrolyzate from 180° C. at the exit of hydrolysis reactor 16, to approximately 150° C. at the entrance to prehydrolysis reactor 18. It is important to maintain the temperature of the heat exchanger wall in contact with the hydrolyzate, above 130° C., in order to minimize the deposition of tars on the walls of the exchanger.

In passing through flash valve 108, the temperature and pressure of the hydrolyzate are reduced to quench the hydrolysis and degradation reactions. The flash valve also operates to regulate the pressure in the reactor train. The flash valve controls upstream pressure and is set at a pressure high enough to suppress boiling anywhere in the system. By setting the flash valve to control in this manner, it also ensures that fluid will not exit the reactor until the reactor has reached its full capacity of liquid. Thus, flash valve 108 and flash drum 110 are the preferred means for regulating temperature and pressure because they are less subject to fouling. However, other combinations of pressure control valves and heat exchangers can be designed to accomplish the same function.

The stream exiting flash valve 108 is separated into liquid and vapor streams in flash drum 110. Liquid hydrolyzate is removed from the bottom of the drum, while flash vapors exit from the top of the drum and are condensed in heat exchanger 112. The temperature of the exiting hydrolyzate is controlled by the pressure in flash drum 110. The temperature in flash drum 110 varies from about 100°-130° C. The desired flash temperature depends upon the nature of the downstream processing and the methods which will be used to purify the sugars or prepare them for fermentation.

Operating cycles can generally vary from about 10 to 60 minutes depending upon feedstock characteristics, operating conditions, and number of reactors. After each operating cycle the valving is adjusted to allow for a reactor containing fresh feed to be brought into the operating cycle and the reactor containing spent solids to be isolated and its contents discarded.

A shifting in this order and sequence can continue indefinitely for several separate operating cycles, thereby approximating a continuous, counter-current flow operation, without counter-current movement of wood particles.

A progressing batch hydrolysis system can be operated with as few as two operating percolation hydrolysis reactors, and with no upper limit governed only by using as many reactors as is practicable under the circumstances.

It is apparent from the operating sequence of the present invention that the percolation hydrolysis reactor having initial contact with the dilute acid stream in each sequence is at the most advanced stage of hydrolysis, that is, it has progressed from operating as a freshly charged prehydrolysis percolation reactor, having only its hemicellulose component converted to glucose, to operating as a hydrolysis reactor, having the cellulose component of the wood converted to glucose, and finally becoming the initial hydrolysis reactor to contact the dilute acid, after which, the reactor is isolated, cleaned, recharged, and reconnected as the final prehydrolysis percolation reactor in the operating cycle.

The size of the reactors, the extent to which the reactors are filled with wood particles, and the time and rate of flow of the dilute acid solution through the reactors are coordinated so that minimal degradation occurs before the liquid product is cooled, and to achieve maximum concentration of the glucose in the liquid acid, and maximum production efficiency.

The rationale for the operating sequence of the present invention is that the dilute acid solution at an elevated temperature and pressure passing through the interconnected series of percolation reactors, reacts with unreacted portions of the wood particles contained therein.

The rate of production of sugars is greatest where fresh solids are introduced into the system in the first prehydrolysis reactor, and in the first hydrolysis reactor, where the crystalline cellulose is first subject to conditions severe enough to cause hydrolysis. As the liquids flow in a counter-current manner, the majority of the sugars are produced adjacent to the liquid outlet. Therefore, the sugars will be washed from the reactor in a minimal amount of time.

In conducting the progressive batch hydrolysis process, the acid temperatures for the hydrolysis reactors can vary from about 175° to 200° C., preferably 180° to 190° C. The acid temperatures in the prehydrolysis percolation reactors are controlled in the range of about 135° to 160° C., preferably about 140° to 150° C.

The prehydrolysis percolation reactors are maintained at lower temperatures than the hydrolysis reactors because it is much easier to convert the hemicellulose contained in the wood particles to glucose, rather than the cellulose, which is more chemically resistant.

Therefore, a relatively cooler dilute sulfuric acid solution on the order of 140° to 150° C. is sufficient to convert hemicellulose into sugar or glucose. Moreover, at temperatures of about 150° C. and below, the sugar degradation reaction is very slow. Thus, it is possible to obtain glucose and xylose from hemicellulose at yields of up to 95 percent, because the sugars are removed from the reactor before they have had time to degrade.

The percolation hydrolysis reactors, which first function as prehydrolysis percolation reactors until conversion of hemicellulose is completed, primarily contain cellulose and lignin. Thus, the temperature of the dilute acid solution in the percolation hydrolysis reactors is about 180° to 190° C. to convert the cellulose to glucose. Since substantially all of the hemicellulose component of the wood particles has been previously converted to glucose, the problem of degradation at this stage of the operation is minimized.

If the dilute sulfuric acid solution were maintained at 180° C. throughout the entire system, including the prehydrolysis percolation reactors, there would be substantial degradation of the sugars converted from the hemicellulose.

Several different internal reactor configurations could be designed which would have the same effect as that described. With the reactor operated liquid full, as described in the text, there are many possible arrangements of liquid inlets and outlets. Further, the reactor could be operated with liquid trickling down through the bed of particulate lignocellulose, and the hydrolyzate liquid pumped from vessel to vessel.

Into the hydrolysis reactors which are disconnected from the system and cleaned of spent solids and residues (primarily lignin) left over after completion of the hydrolysis sequence, a fresh charge of wood particles is placed therein. The reactor vessel containing freshly charged wood particles can then be exposed to low pressure steam to displace air contained in the wood particles. Alternatively, a vacuum can also be placed on the reactor vessel, and the excess air drawn out.

Operating temperatures for the low pressure steam are on the order of about 100° C. Higher temperatures and pressures can be used, which may accelerate the displacement of air. Ordinarily, wood particles are approximately 50 percent air.

Another treatment for the freshly charged reactor prior to its connection to the operating system can be to contact the particles contained therein with cold acid, preferably under pressure, to force the acid into the wood particles. Excess acid solution can then be drained off and the reactor reconnected on stream in the sequence of progressing batch hydrolysis, as the first prehydrolysis percolation reactor in the operating sequence.

The foregoing description is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to falling within the scope of the invention as defined by the claims which follow.

The embodiments of the invention in which an exclusive property or privilege is claimed are defined as follows:

1. A progressive batch prehydrolysis and hydrolysis process for producing sugar from a lignocellulosic feedstock, comprising:

(a) providing at least one percolation reactor, said reactor being initially charged with lignocellulosic feedstock including hemicellulose components and cellulose components, which feedstock has not been prehydrolyzed;

(b) prehydrolyzing said feedstock by passing a liquid stream of dilute acid into and then serially through said reactors in (a) which are charged with said lignocellulosic feedstock, said dilute acid being at a temperature, pressure, and flow rate sufficient to convert, by hydrolysis, substantially all of the hemicellulose components of said feedstock to sugar comprising xylose, glucose and other sugars carried by said liquid acid stream without completely hydrolyzing said cellulose components of said feedstock, said liquid stream of dilute acid being at a temperature and maintained at a temperature such that said sugars produced within said reactors from said hemicellulose component and carried by said dilute acid stream are not subjected to any significant heat degradation;

(c) cooling and recovering said dilute sugar containing acid stream after it exits the last reactor in (a);

(d) providing at least one additional percolation reactor initially charged with said lignocellulosic feedstock including hemicellulose components and cellulose components, which feedstock has not been prehydrolyzed;

(e) serially connecting said reactors in (a) to and upstream of said additional reactors in (d);

(f) passing a liquid stream of dilute acid serially through said reactors in (a) which are now charged with prehydrolyzed lignocellulosic feedstock which is now substantially free of unreacted hemicellulose, said liquid stream of dilute acid being at a temperature, said temperature being higher than the temperature of said liquid acid stream in (b), pressure and flow rate sufficient to convert substantially all of said remaining cellulose components of said feedstock to sugars comprising glucose and other sugars carried by said dilute acid stream;

(g) cooling said dilute acid stream containing sugar after exiting the last reactor in (f), and then prehydrolyzing the feedstock in the additional reactors in (d) by feeding said dilute acid stream containing sugar serially through said additional reactors in (d) charged with said lignocellulosic feedstock including hemicellulose components and cellulose components, said dilute acid being at a temperature, pressure and flow rate sufficient to convert by hydrolysis substantially all of the hemicellulose components of said feedstock to sugars comprising xylose, glucose and other sugars carried by said liquid acid stream without completely hydrolyzing said cellulose components of said feedstock, said cooled liquid stream being at a temperature and maintained at a temperature such that said sugars produced from said hemicellulose components of said feedstock are not subjected to any significant heat degradation; and then (h) cooling and recovering said dilute sugar containing acid stream after it exits the last reactor in (g).

2. The process of claim 1, wherein said lignocellulosic feedstock comprises wood particles selected from the group consisting of wood chips, sawdust, wood shavings, agricultural residues, municiple solid waste, and mixtures thereof.

3. The process of claim 2, wherein said lignocellulosic feedstock comprises wood chips.

4. The process of claim 1, wherein after the feedstock contained in the first percolation reactor in (f) has been substantially converted to glucose, said reactor is disconnected from the operating sequence, and the supply stream of dilute acid is diverted to the next percolation reactor in the operation.

5. The process of claim 4, wherein a freshly charged percolation reactor is connected as the last additional reactor in the reactors in (d).

6. The process of claim 5, wherein said freshly charged percolation reactor, prior to being serially connected to the process, is exposed to a stream of low pressure steam for a time sufficient to displace the air contained in the feedstock.

7. The process of claim 6, wherein the feedstock in the freshly charged percolation reactor is contacted with dilute acid for a time sufficient to fully soak said feed stock.

8. The process of claim 1, wherein the percolation reactors in (f) are operated at temperatures of about 180° C. to 190° C., and the percolation reactors in (b) and (g) are operated at temperatures of about 140° C. to 150° C.

9. The process of claim 1, wherein the dilute acid is an inorganic acid selected from the group consisting of sulfuric, hydrochloric, phosphoric, nitric and hydrofluoric.

10. The process of claim 1, wherein the dilute acid is sulfuric.

11. The process of claim 10, wherein the sulfuric acid has a concentration of about 0.2 to about 2 percent.

12. The process of claim 1, wherein the flow rate of the dilute acid stream through the hydrolysis reactors in each batch sequence is adjusted so that the average contact time of the dilute acid with the feedstock contained in the reactor vessels is about 10 to 60 minutes per reactor.

13. The process of claim 12, wherein the average contact time varies from about 15 to 30 minutes per reactor.

14. The process of claim 1, wherein the cooling of the sugar-containing dilute acid stream exiting the last percolation reactors in (f) is accomplished by passing said acid stream through either a flash tank or heat exchanger prior to entering the reactors in (g).

15. The process of claim 1, wherein the cooling of the sugar-containing dilute acid stream exiting the last percolation reactor in (b) and (g) is accomplished by passing said sugar-containing dilute acid stream through a flash tank prior to recovering the sugar-containing acid.

16. The process of claim 1, wherein the temperature profile in the hydrolysis is adjusted by heat exchangers between the hydrolysis percolation reactors.

17. The process of claim 1 wherein the percolation reactors in (f) are operated at temperatures in the range of about 170° C. to about 200° C., and the percolation reactors in (b) and (g) are operated at temperatures in the range of about 135° C. to about 160° C.

18. A progressive batch prehydrolysis and hydrolysis process for producing sugar from a lignocellulosic feedstock, comprising:

(a) providing at least one percolation reactor, said reactor being initially charged with lignocellulosic feedstock including wood chips having hemicellulose components and cellulose components, which feedstock has not been prehydrolyzed;

(b) prehydrolyzing said feedstock by passing a liquid stream of dilute sulfuric acid having a concentration in the range of about 0.2% to about 2.0% by weight, serially through said reactors in (a) which are charged with said lignocellulosic feedstock, said dilute acid being at a temperature in the range of about 140° C. to about 150° C., pressure, and flow rate sufficient to convert, by hydrolysis, substantially all of the hemicellulose components of said feedstock to sugars comprising xylose, gluose and other sugars carried by said liquid sulfuric acid stream without completely hydrolyzing said cellulose components of said feedstock, said liquid stream of dilute acid being at a temperature and maintained at a temperature less than about 160° C. so that said sugars produced within said reactors from said hemicellulose component and carried by said dilute sulfuric acid stream are not subjected to any significant heat degradation;

(c) cooling and recovering said dilute sugar containing sulfuric acid stream after it exits the last reactor in (a);

(d) providing at least one additional percolation reactor initially charged with said lignocellulosic feedstock including hemicellulose components and cellulose components, which feedstock has not been prehydrolyzed;

(e) serially connecting said reactors in (a) to and upstream of said additional reactors in (d);

(f) passing a liquid stream of dilute sulfuric acid serially through said reactors in (a) which are now charged with prehydrolyzed lignocellulosic feedstock which is now substantially free of unreacted hemicellulose, said liquid stream of dilute sulfuric acid being at a temperature, in the range of about 180° C. to about 190° C., pressure and flow rate sufficient to convert substantially all of said remaining cellulose components of said feedstock to sugars comprising glucose and other sugars carried by said dilute acid stream;

(g) cooling said dilute sulfuric acid stream containing sugar after exiting the last reactor in (f), and then prehydrolyzing the feedstock in the additional reactors in (d) by feeding said dilute sulfuric acid stream containing sugar serially through said reactors in (d) charged with said lignocellulosic feedstock including hemicellulose components and cellulose components at a temperature in the range of about 140° C. to about 150° C., pressure and flow rate sufficient to convert by hydrolysis substantially all of the hemicellulose components of said feedstock to sugars comprising xylose, glucose and other sugars carried by said liquid acid stream without completely hydrolyzing said cellulose components of said feedstock, said cooled liquid stream being at a temperature and maintained at a temperature less than about 160° C. so that said sugars produced from said hemicellulose components of said feedstock are not subjected to any significant heat degradation; and then (h) cooling and recovering said dilute sugar containing sulfuric acid stream after it exits the last reactor in (g).

* * * * *